US007647713B2

(12) United States Patent
Malacrino

(10) Patent No.: US 7,647,713 B2
(45) Date of Patent: Jan. 19, 2010

(54) BUCKET OR SCOOP WITH ADJUSTABLE CAPACITY

(76) Inventor: Gianluca Malacrino, Via Canonico Chiesa 5, Monta (IT) I-12046

( * ) Notice: Subject to any disclaimer, the term of this patent is extended or adjusted under 35 U.S.C. 154(b) by 0 days.

(21) Appl. No.: 10/545,502

(22) PCT Filed: Feb. 24, 2004

(86) PCT No.: PCT/EP2004/001793

§ 371 (c)(1),
(2), (4) Date: Jun. 12, 2006

(87) PCT Pub. No.: WO2004/076752

PCT Pub. Date: Sep. 10, 2004

(65) Prior Publication Data

US 2006/0230648 A1 Oct. 19, 2006

(30) Foreign Application Priority Data

Feb. 25, 2003 (IT) ..... GE2003A0015

(51) Int. Cl.
*E02F 3/40* (2006.01)

(52) U.S. Cl. ..... 37/409; 37/444

(58) Field of Classification Search ..... 37/281, 37/384, 398, 409, 429, 430, 466, 444
See application file for complete search history.

(56) References Cited

U.S. PATENT DOCUMENTS 3,158,273 A * 11/1964 Brown ..... 414/705
3,782,573 A 1/1974 Garwood
4,073,077 A * 2/1978 Essel et al. ..... 37/281
RE31,045 E * 10/1982 Essell et al. ..... 37/281
4,369,847 A * 1/1983 Mizunuma ..... 172/815
4,667,426 A * 5/1987 Howard et al. ..... 37/232
5,392,538 A * 2/1995 Geerligs et al. ..... 37/268
5,493,797 A * 2/1996 Jackson ..... 37/285
5,918,390 A 7/1999 Ruff
6,442,877 B1 * 9/2002 Quenzi et al. ..... 37/281
6,877,258 B2 * 4/2005 Frey ..... 37/281
6,994,513 B2 * 2/2006 Harris ..... 414/722
7,429,158 B2 * 9/2008 McFarland ..... 414/722

FOREIGN PATENT DOCUMENTS

DE 8804501 U 6/1988
DE 29517230 U 3/1996
EP 0435796 A 7/1991
GB 2341843 A 3/2000
JP 56059929 A 5/1981

* cited by examiner

*Primary Examiner*—Gary S Hartmann
(74) *Attorney, Agent, or Firm*—R. Neil Sudol; Henry D. Coleman; William J. Sapone

(57) ABSTRACT

A bucket or scoop with adjustable capacity has a fixed structure which forms an external rigid element and also has one or several mobile elements, complementary to the fixed structure, which slide inside the same by means of special devices. The special devices are actuators or pistons fixed either to the fixed structure or to the mobile elements, to occasion a reciprocal movement thereof. Sliding guides are arranged parallel to the direction of action of the pistons.

11 Claims, 17 Drawing Sheets

BUCKET OR SCOOP WITH ADJUSTABLE CAPACITY

BACKGROUND OF THE INVENTION

The present invention relates to an adjustable-capacity bucket for backhoe or loader.

According to the prior art, buckets for backhoes or loaders applied to excavators, earth-movers or machines for moving materials in general have a structure that has a constant and non-modifiable capacity.

The main drawback that is observed with conventional buckets for backhoes or loaders is that since their capacity is not modifiable, machines with different capacities are needed for each individual different requirement.

This drawback entails cost burdens arising from the need to have multiple machines available, with considerable waste of time during work when a machine that is different from the one being used is needed due to suspension of work, the request for the appropriate machine, the wait for its delivery on site, and its installation.

These drawbacks have been overcome with the adjustable-capacity bucket for backhoe or loader according to the present invention.

OBJECTS OF THE INVENTION

The aim of the present invention is to provide a bucket for backhoe or loader that allows to adjust, on site and easily, its loading capacity according to the various requirements.

For this purpose, the present invention consists of an adjustable-capacity bucket for backhoe or loader, which is constituted partly by a fixed structure and partly by one or more movable members, which can slide on the fixed structure by means of adapted devices for mutual movement, so as to be able to adjust the width of the bucket and accordingly its capacity with simple operations.

To achieve the intended aim, according to a preferred embodiment, the adapted devices are constituted by pistons fixed both to the fixed structure and to the movable members so as to actuate their mutual movement.

In order to assist the pistons that actuate the movement of the movable members, sliding guides are arranged parallel to the direction of actuation of the pistons.

The fixed structure is substantially C-shaped and constitutes a rigid external member inside which one or more complementary movable members slide.

Some of the many advantages that are achieved with the present invention are the following.

The main advantage of the present invention is the great cost saving that is achieved by virtue of the possibility to deal with different needs by means of a single tool, by adjusting the breadth of the bucket, which allows to even double, and more than double, the loading capacity with a single machine.

A further advantage is the adaptability of the bucket even during work without unnecessarily wasting time. For example, to produce an excavation with a required cross-section and a width of 80 cm, it is possible to use a 60-cm bucket extended by 10 cm on each side. If a block or a loose shoulder is encountered during excavation, in order to widen the excavation it is not necessary to stop work to replace the bucket, but it is sufficient to actuate the widening of the bucket, deal with the critical situation, and then reduce again the width of the bucket in order to continue regularly with the excavation with required cross-section.

The fact that the structure of the bucket for backhoe or loader according to the invention is heavier than conventional ones is not a drawback, because the machine to which it is applied is always very heavy and the difference related to the weight of the bucket is not decisive. If deemed appropriate, it is always possible to ballast the machine additionally when it is necessary to move heavier loads.

BRIEF DESCRIPTION OF THE DRAWINGS

All of the advantages cited above and others will become apparent from the description of the following figures, which are provided merely by way of non-limiting example and wherein.

In the various figures, similar elements have been designated by the same reference numerals.

DETAILED DESCRIPTION

Figure 1:
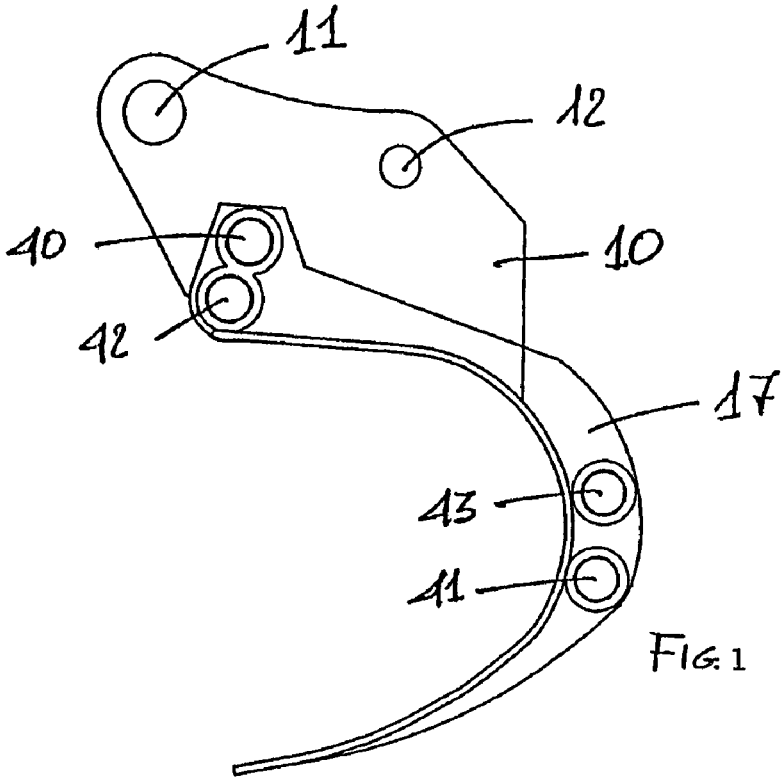
FIG. 1 is a view of a fixed structure with the frame for coupling to the excavator.

In FIG. 1, the reference numeral 10 designates the bucket frame for anchoring to the arm of the excavator (not shown in the drawings), with which conventional backhoe and loader buckets are usually provided.

The pins for fixing to the excavator pass through the holes 11 and 12.

According to the invention, a fixed structure 17 is connected rigidly to the frame 10, is substantially C-shaped and is preferably obtained by means of a solid and/or box-like bent metal plate, in order to give it great rigidity and strength.

The movable members, which are suitable to slide within the fixed structure 17, allow to vary the loading capacity of the bucket by virtue of their sliding. The movable members also are preferably provided by means of a metal plate bent into a C-shape and their external contour is complementary to the internal contour of the fixed structure 17.

The movable members are connected to the fixed structure 17 by means of actuators constituted for example by pistons, where the term "piston" is used to designate the assembly constituted by a cylinder, a piston and the corresponding rod.

Figure 2:
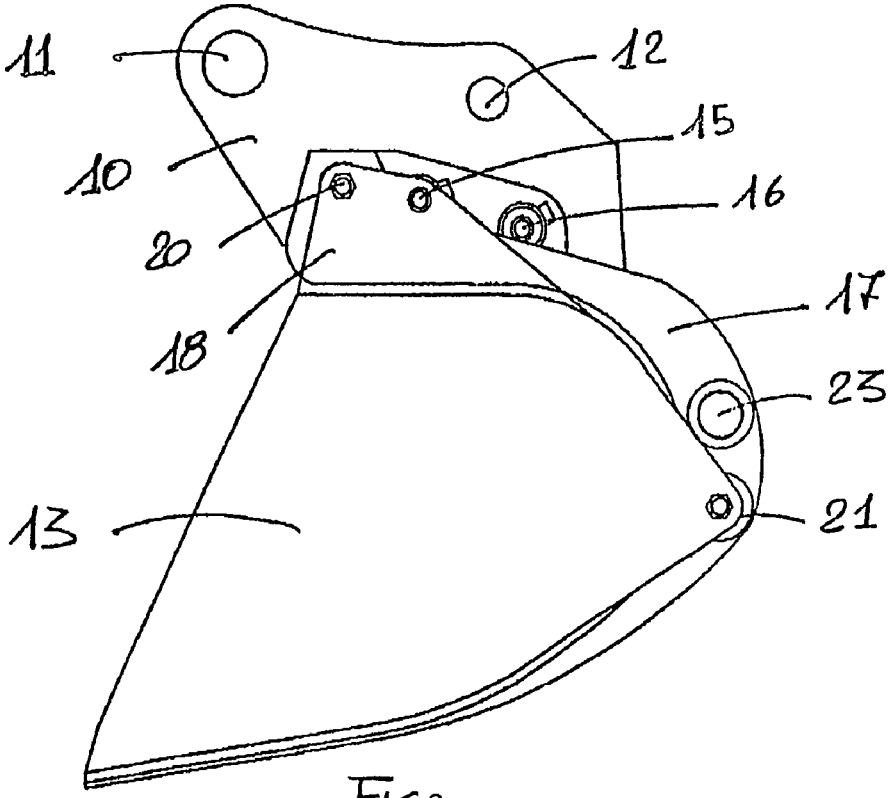
FIG. 2 is a view of a movable member applied to the fixed structure.

FIG. 2 illustrates a movable member 13 applied to the fixed structure 17.

Figure 3:
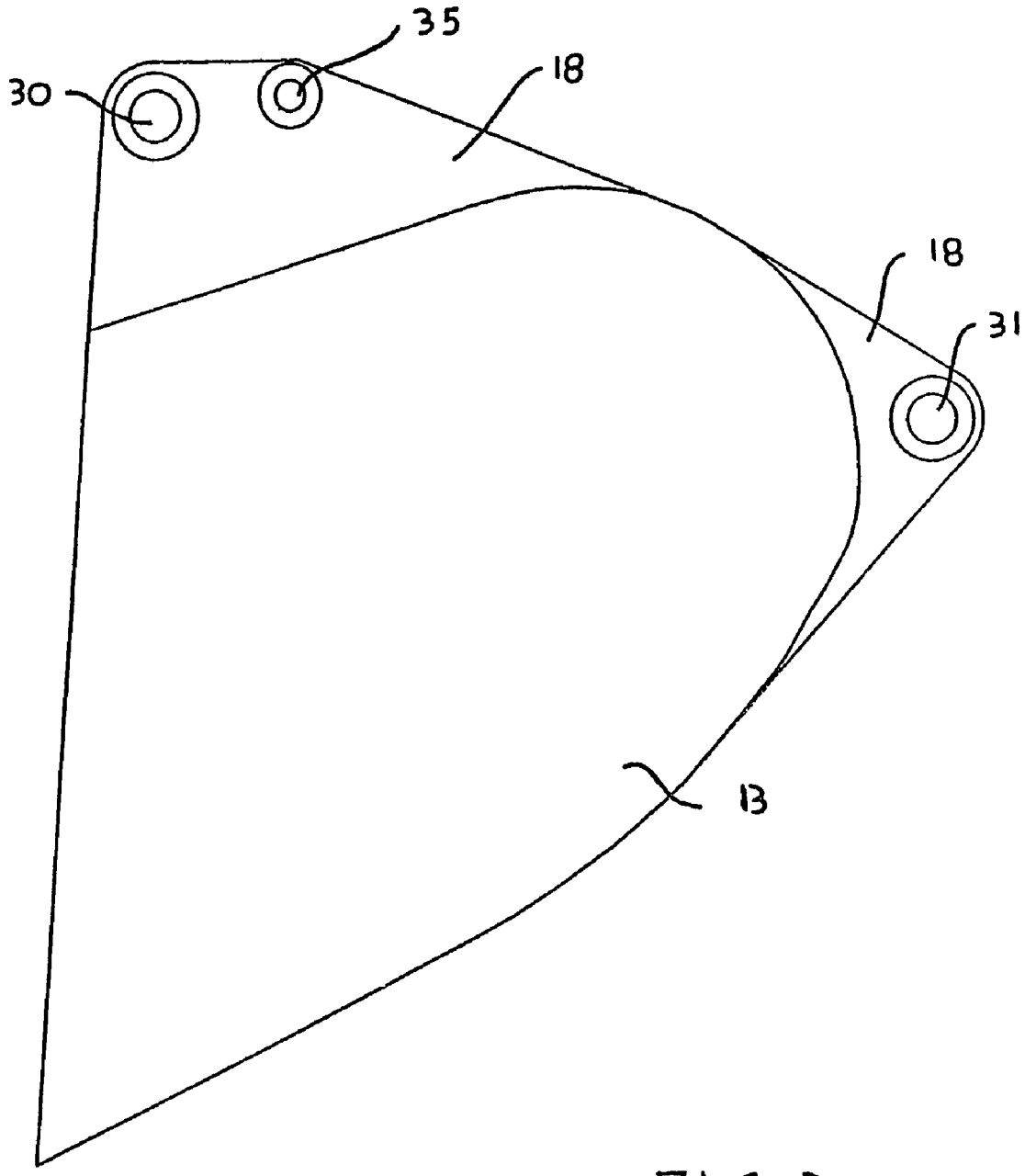
FIGS. 3 and 4 are respectively side views of the movable members.
Figure 4:
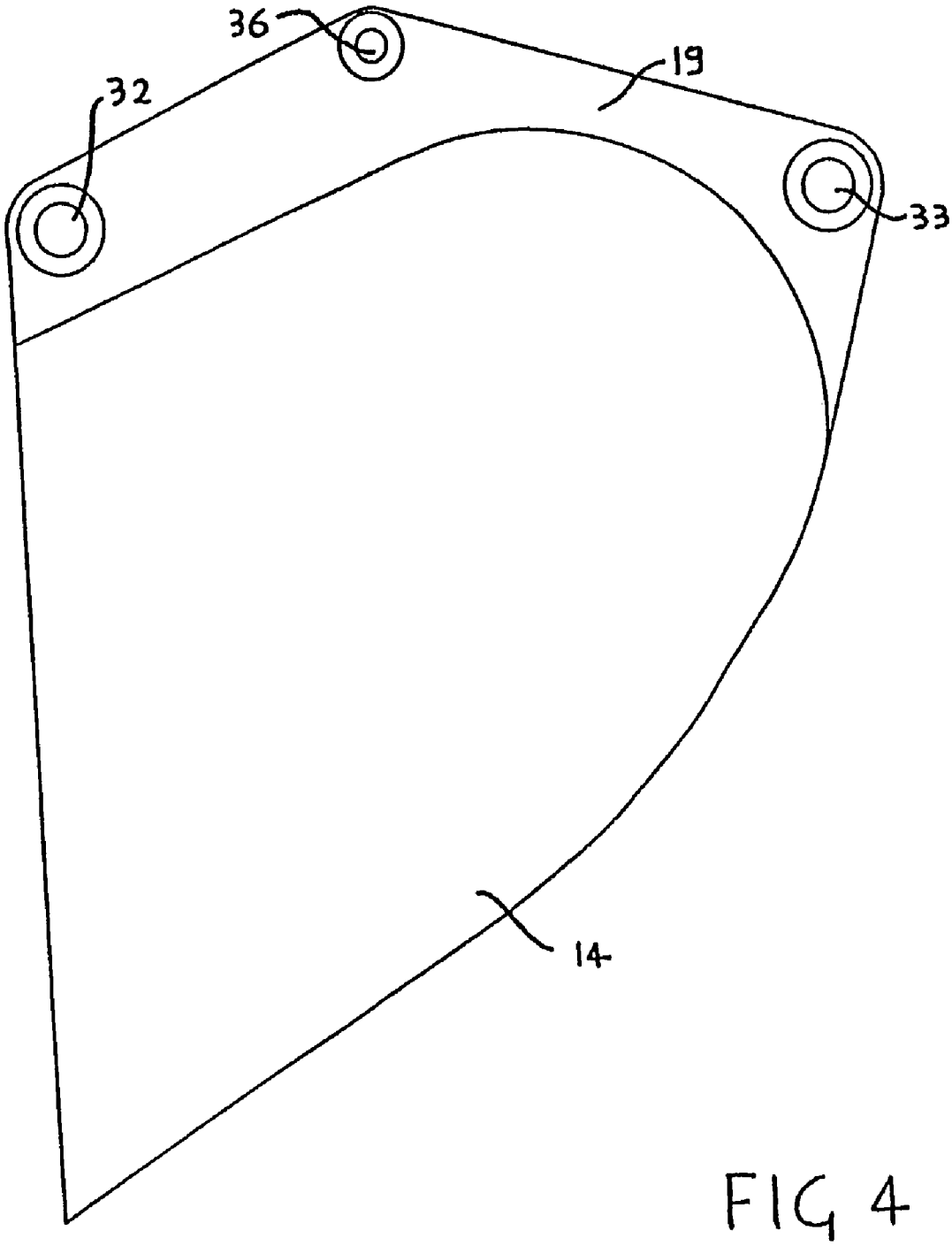

According to a particular example of embodiment, the internal movable members are two, 13 and 14, and are shown individually in FIGS. 3 and 4. The movable members are mirror-symmetrically identical except for a protruding wing, designated by the reference numerals 18 and 19. These wings 18 and 19 are meant respectively to connect the movable members 13 and 14 to the fixed structure 17.

The pistons, which are two in the example of FIG. 2 and are designated by the reference numerals 15 and 16, are fixed by means of the cylinder to the fixed structure 17, and the rod is fixed respectively to the protruding wings 18 and 19 at the holes 35 and 36. The two pistons 15 and 16 are mutually parallel and work so as to generate movement in two mutually opposite directions.

The wings 18 and 19 have different contours or shapes so as to allow both the coupling of the stem of the corresponding piston and leave free the space for the movement of the opposite stem and the coupling of the corresponding two sliding guides.

In the illustrated example, there are two sliding guides for each movable member, respectively 20 and 21 for the movable member 13 and 22 and 23 for the movable member 14.

Holes 30 and 31 for the passage of the guides 20 and 21 are provided on the wing 18 of the movable member 13, and holes 32 and 33 for the passage of the guides 22 and 23 are formed on the wing 19 of the movable member 14. Similar corresponding holes 40, 41, 42, 43 are provided on the fixed structure 17, which is shown in FIG. 1.

The side view of FIG. 2 illustrates the movable member 13, with the wing 18 that allows the coupling of the piston 16 and of the guides 20 and 21.

Figure 6:
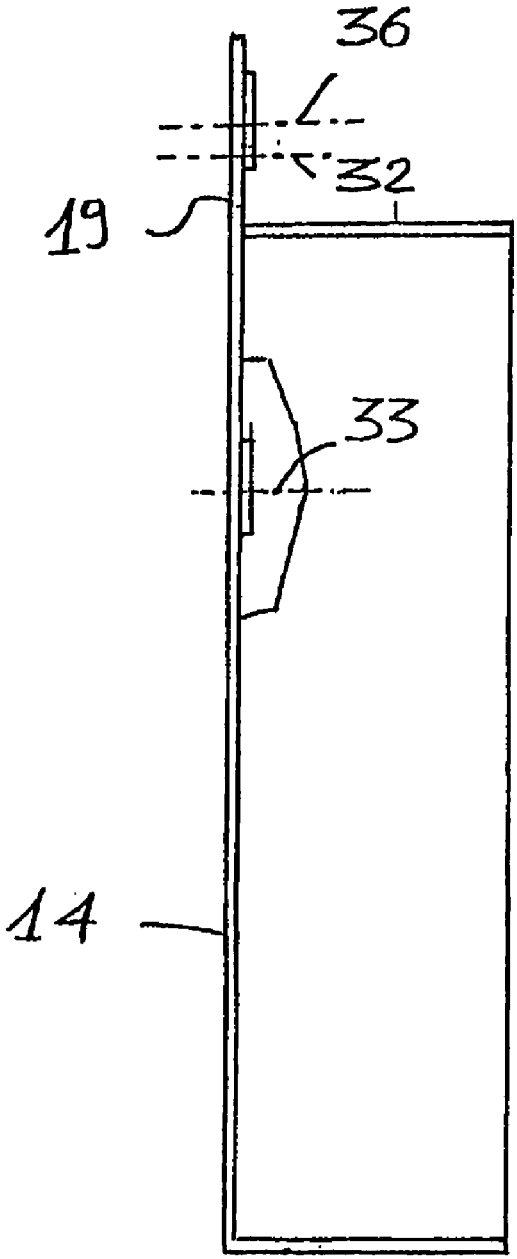
FIGS. 5 and 6 are views of the profile of the movable members.
Figure 5:
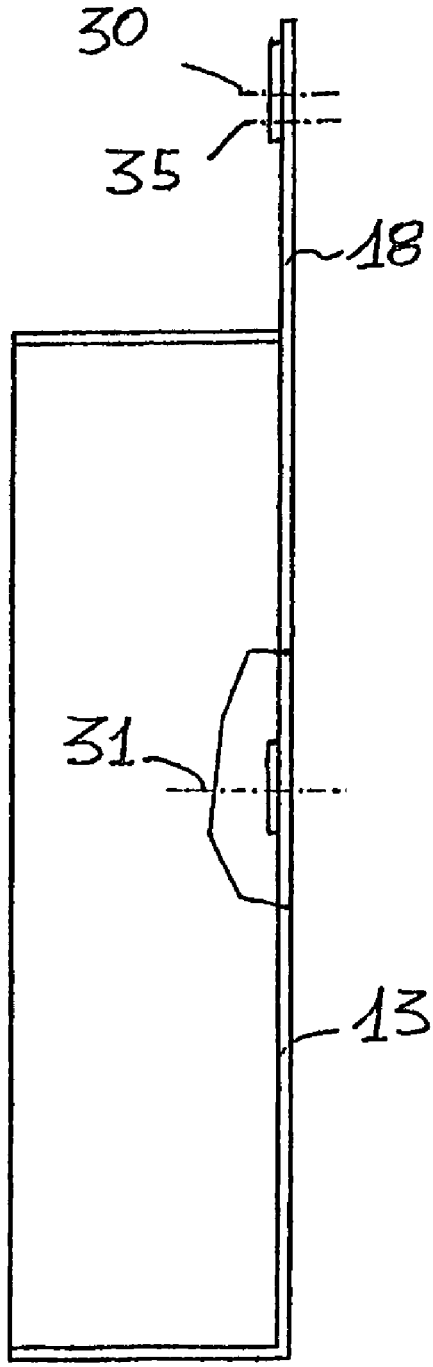

FIGS. 5 and 6 illustrate the profile of the movable members 13 and 14, with the wings 18 and 19 in which the axes of the holes are indicated.

Figure 7:
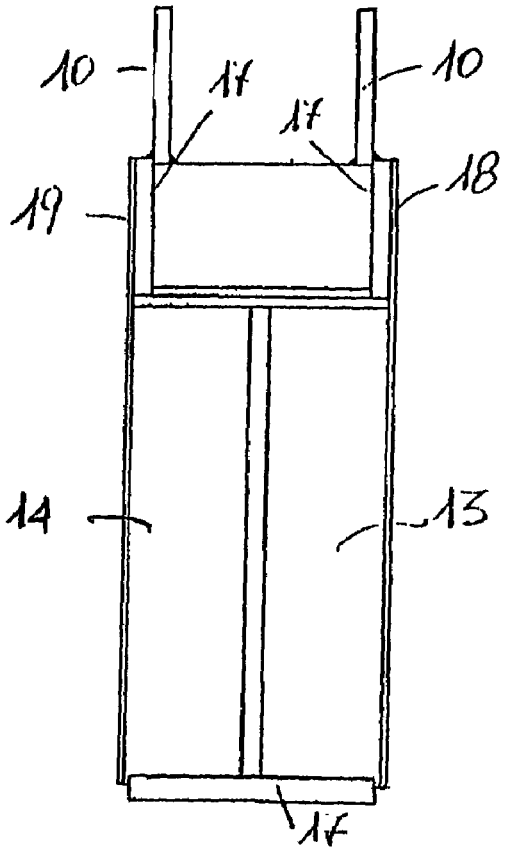
FIG. 7 is a front view of the backhoe bucket of FIG. 2 in the closed position.

FIG. 7 is a front view of the backhoe bucket, with the movable members 13 and 14 in the closed position.

Figure 8:
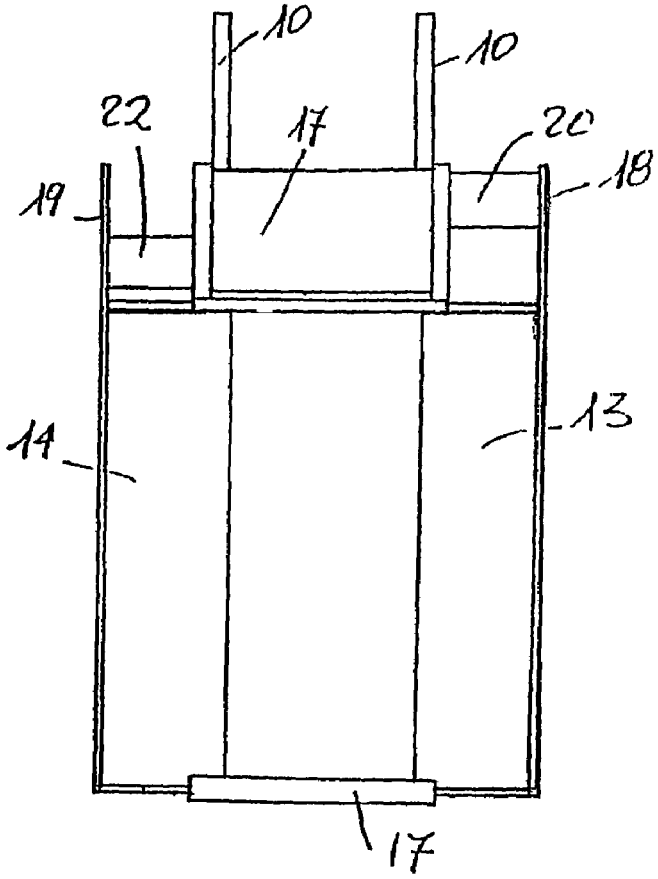
FIG. 8 is a front view of the backhoe bucket of FIG. 2 in the open position.

Likewise, FIG. 8 is a front view of the backhoe bucket with the movable members 13 and 14 in the open position. In the open position, the guides 20 and 22, which protrude beyond the fixed structure 17, become visible.

Figure 9:
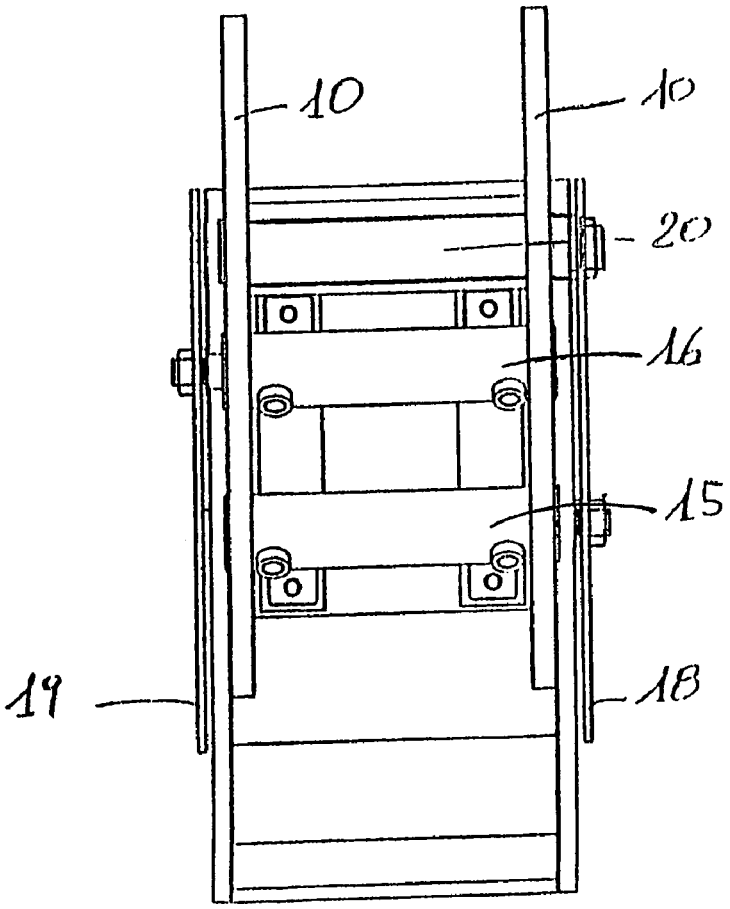
FIG. 9 is a top view of the backhoe bucket of FIG. 2 in the closed position.

The two pistons 15 and 16 are visible in the top view of FIG. 9, are connected respectively to the two wings 18 and 19, and act in opposite directions. The upper sliding guide 20, connected to the wing 18 of the movable member 13, can also be seen.

Figure 10:
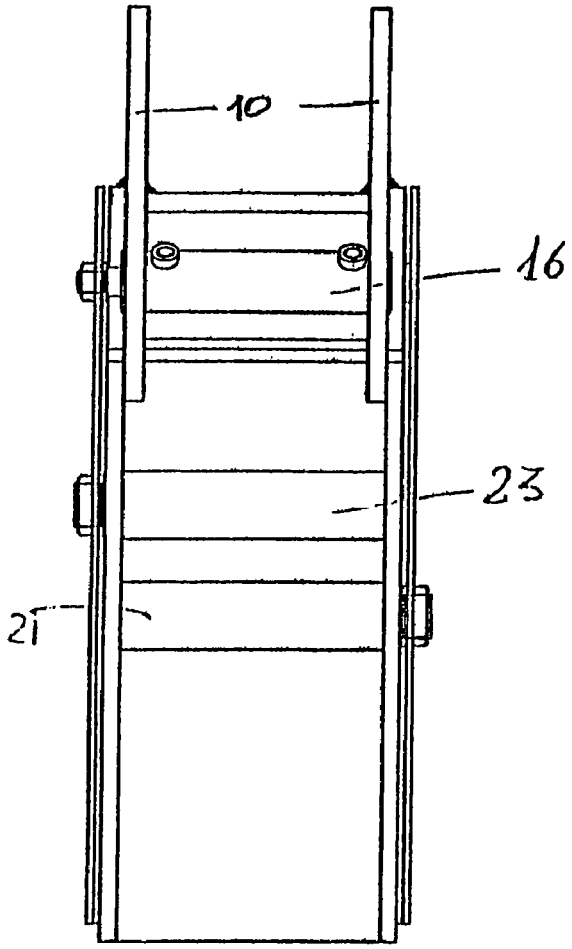
FIG. 10 is a rear view of the backhoe bucket of FIG. 2 in the closed position.

The rear view of FIG. 10 shows the rear guides 21 and 23 and the piston 16.

Figure 11:
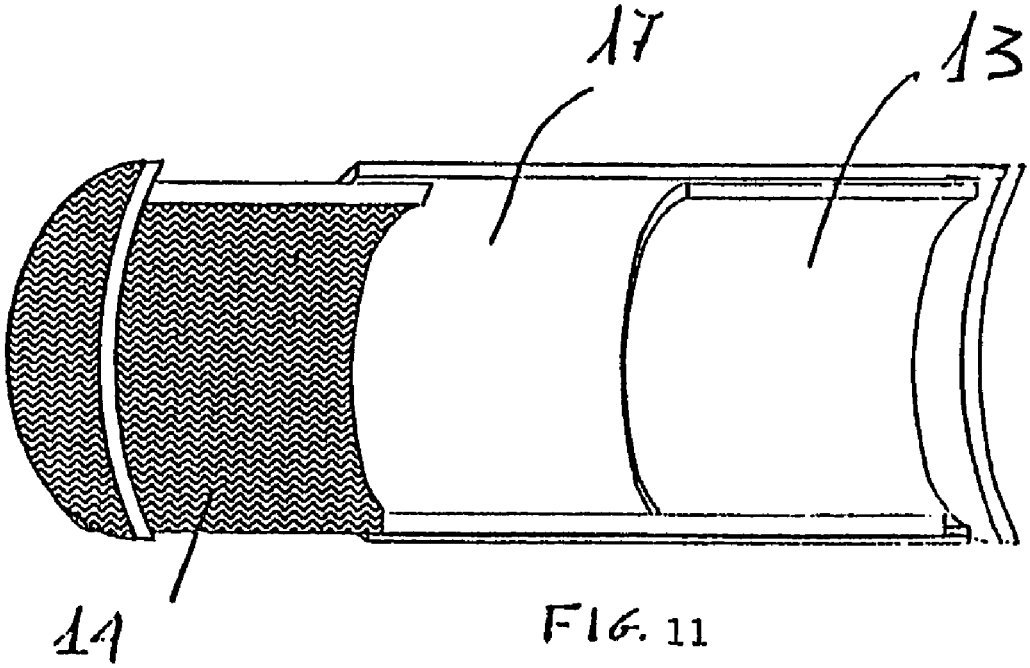
FIG. 11 is a perspective view showing only the fixed structure of a backhoe bucket, with the two movable members.

FIG. 11 is a perspective view of the fixed structure 17, with the two movable members 13 and 14, in which the member 13 is shown in the closed position, contained within the fixed structure 17, while the member 14 is shown in the open, i.e., extended, position, outside the fixed structure 17.

FIGS. 12, 13, 14 and 15 illustrate an example of embodiment of the invention applied to a loader bucket. The operating principle is in fact similar and only the detail of the coupling to the machine is different.

The same reference signs already used for the backhoe bucket have been adopted, with the only addition of a prime sign.

Figure 12:
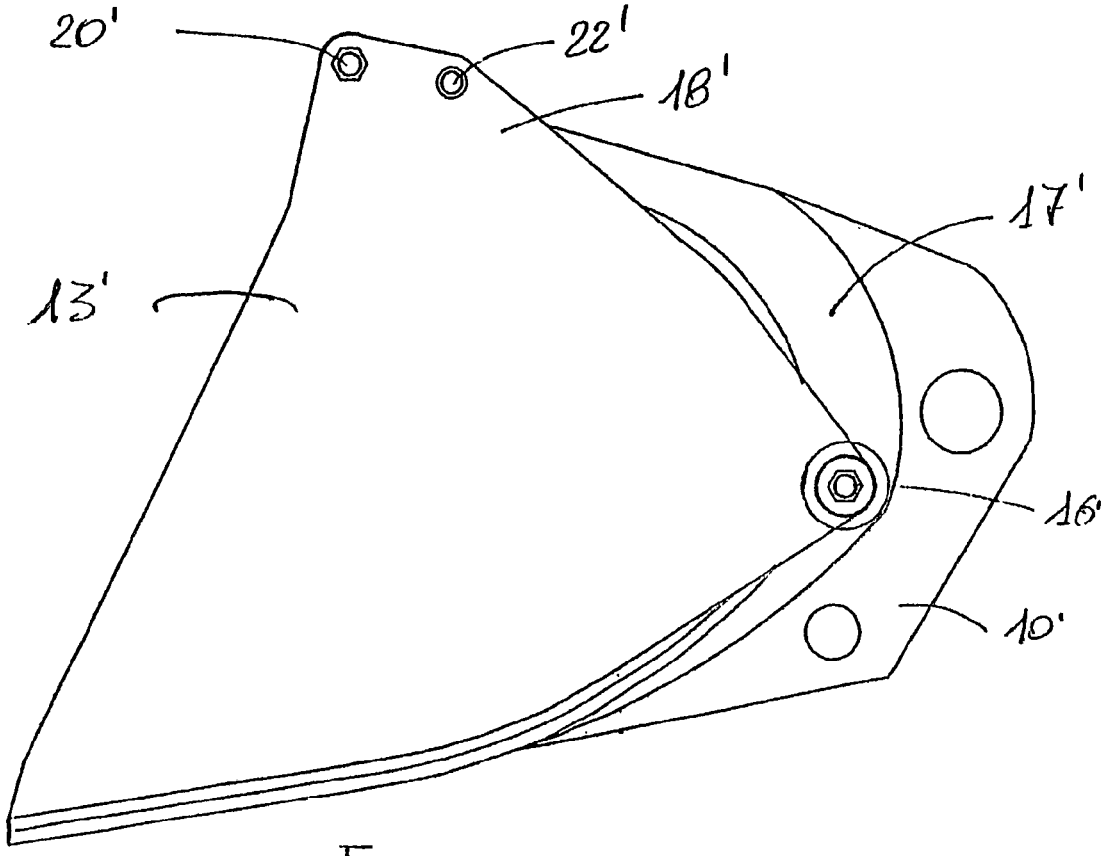
FIG. 12 is a side view of a loader bucket according to the invention.

FIG. 12 is a side view of a loader bucket according to the invention. It can be seen that the only substantial difference with respect to the backhoe bucket is the different position of the frame 10' for the loader bucket. Indeed, instead of being located above the backhoe bucket, the frame 10' is arranged behind the loader bucket. Accordingly, the configuration of the fixed structure 17', of the wings 18', and the arrangement of the pistons 16' and of the guides 20' and 22' changes, but the basic principle remains unchanged.

Figure 15:
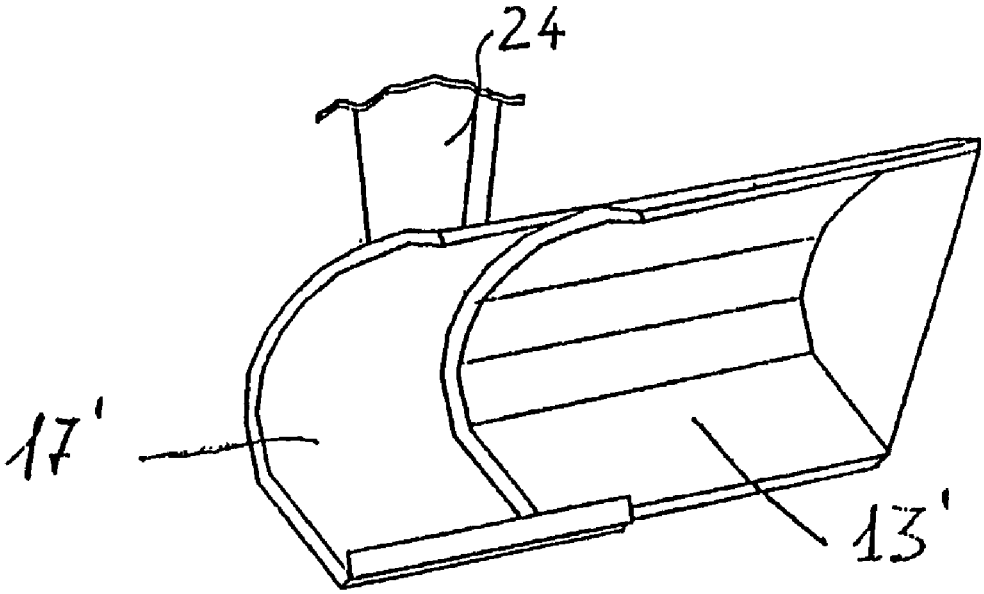
FIG. 15 is a perspective view showing only the rigid structure of a loader bucket, with a movable member.
Figure 13:
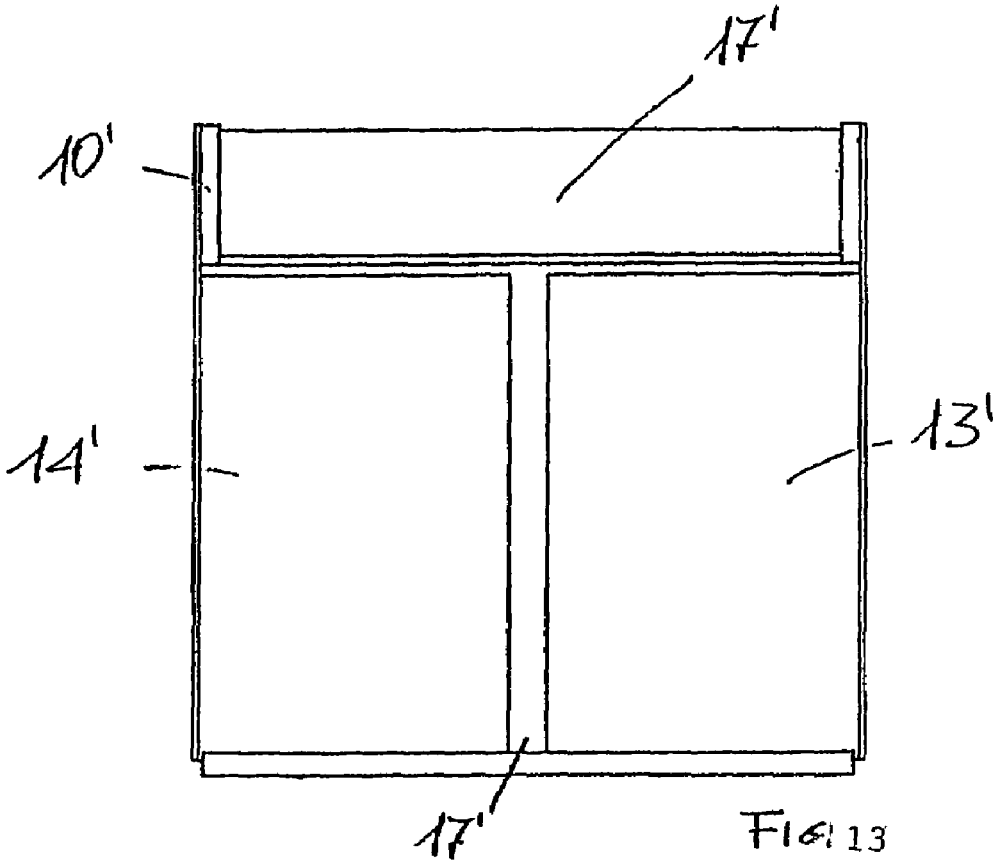
FIG. 13 is a front view of the loader bucket of FIG. 12 in the closed position.
Figure 14:
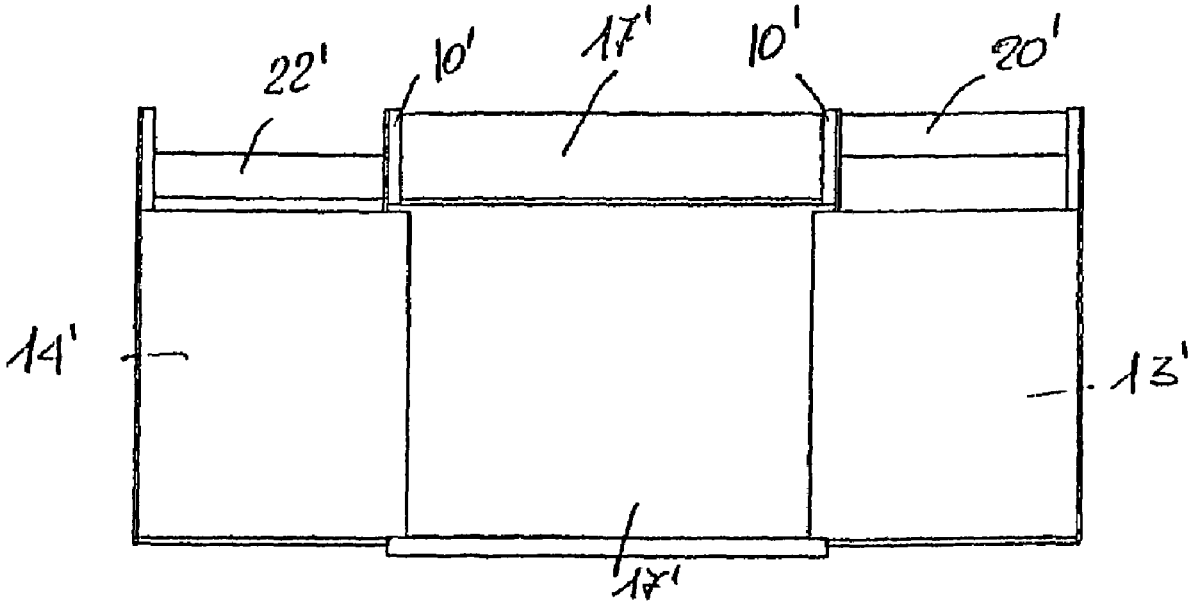
FIG. 14 is a front view of the loader bucket of FIG. 12 in the open position.
Figure 16:
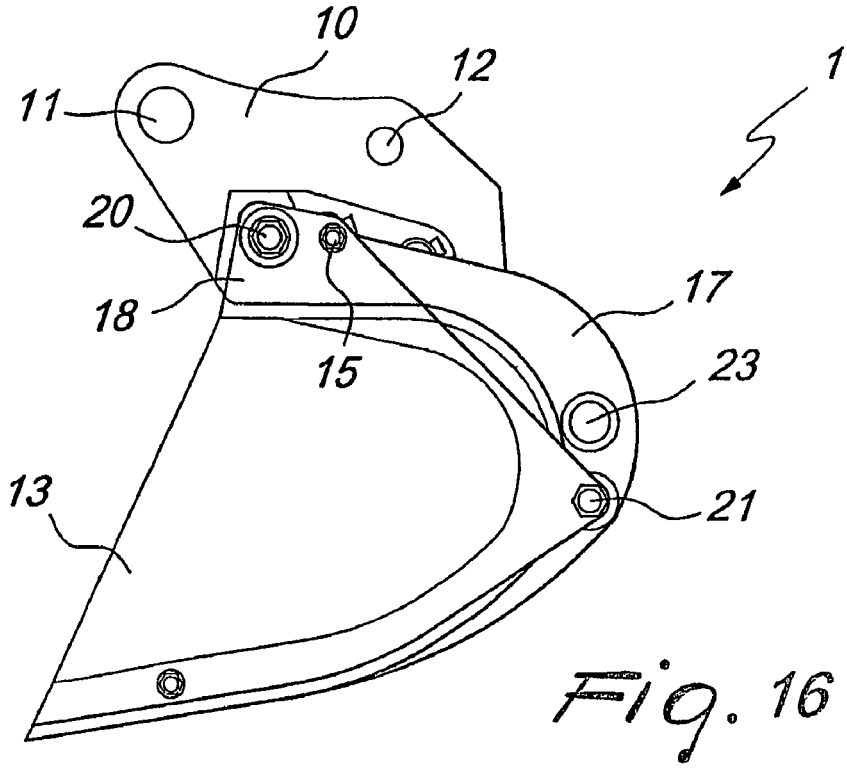
FIG. 16 is a side view of a small backhoe bucket provided with two pairs of cylinders.
Figure 17:
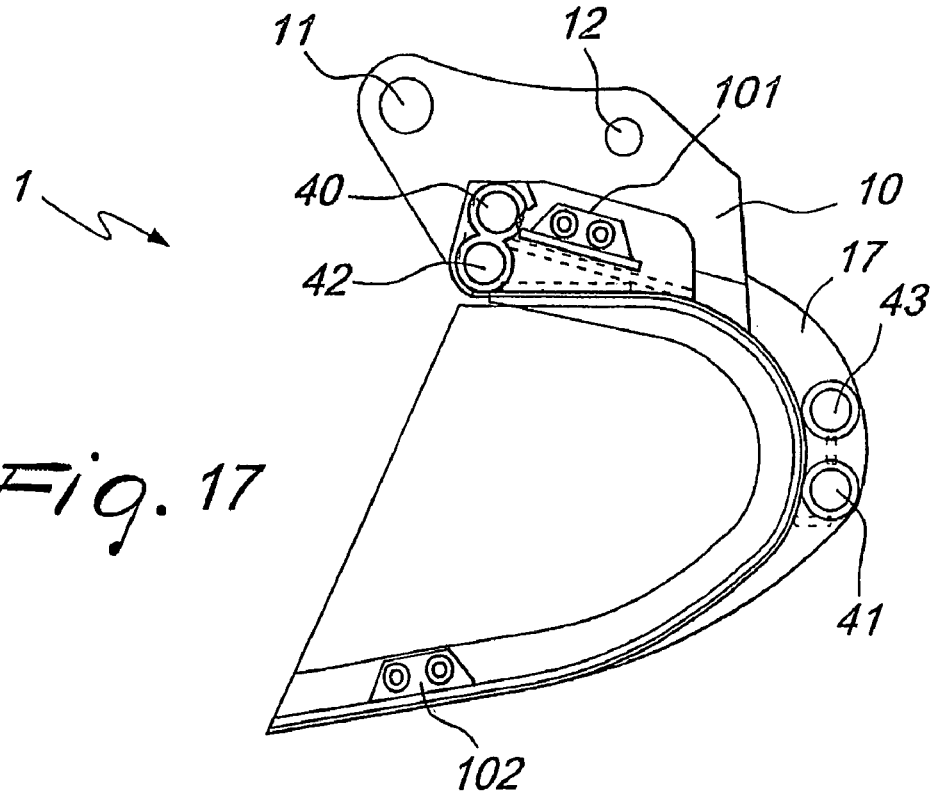
FIG. 17 is a sectional view of the backhoe bucket of FIG. 16.
Figure 18:
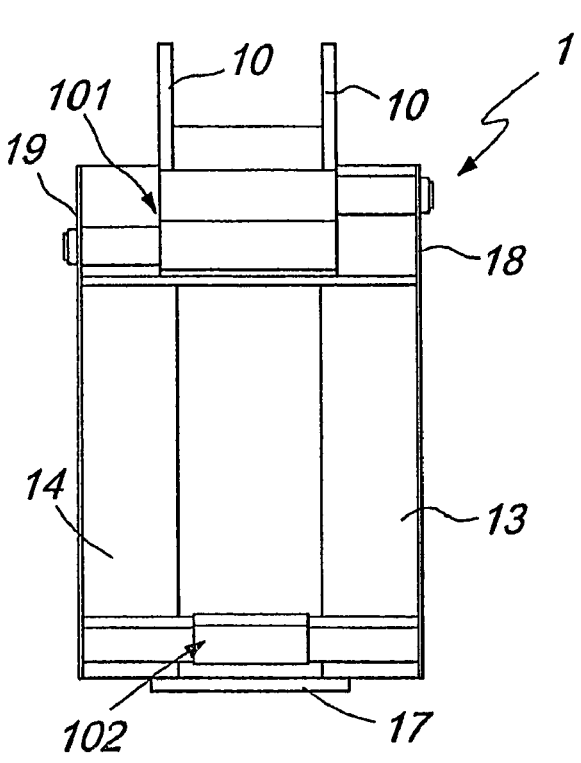
FIG. 18 is a front view of the backhoe bucket of FIG. 17 shown in the open position.
Figure 19:
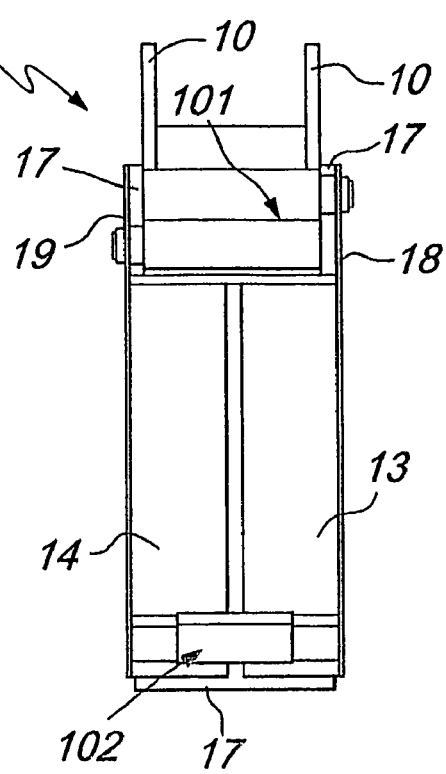
FIG. 19 is a view, similar to FIG. 18, but showing the backhoe bucket in the closed position.
Figure 20:
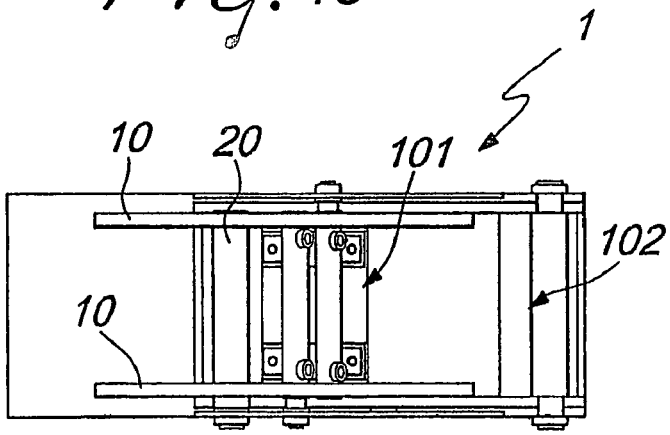
FIG. 20 is a plan view of the backhoe bucket of FIG. 19.
Figure 21:
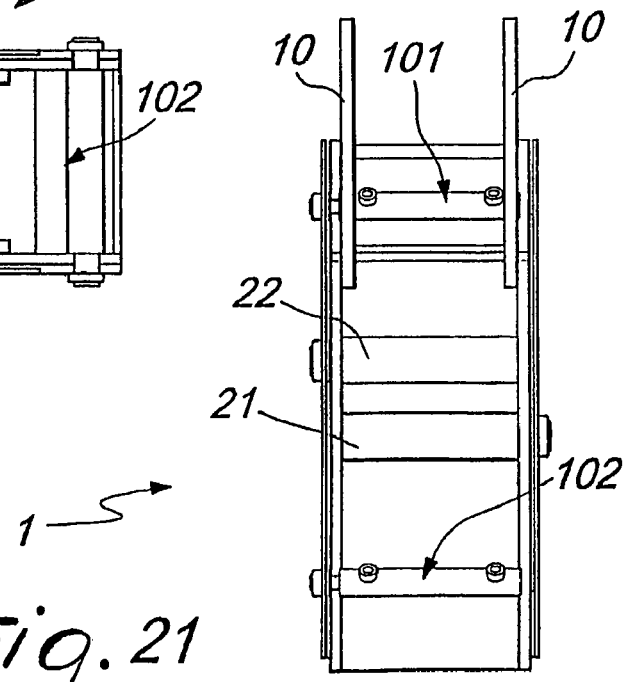
FIG. 21 is a rear view of the backhoe bucket of FIG. 20.
Figure 22:
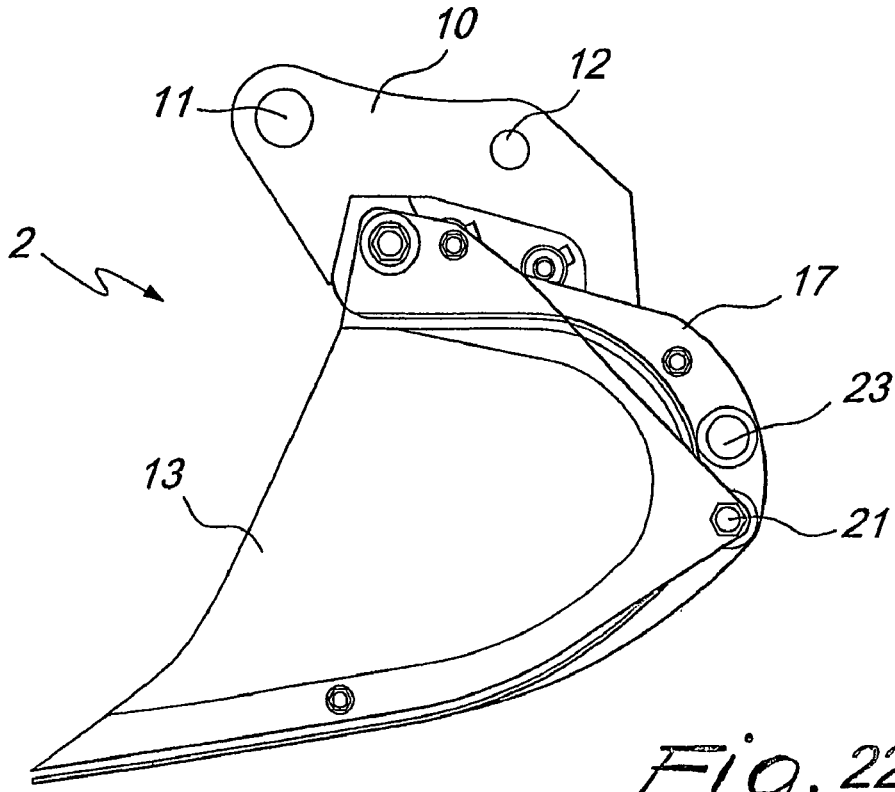
FIG. 22 is a side view of a medium backhoe bucket provided with three pairs of cylinders.
Figure 23:
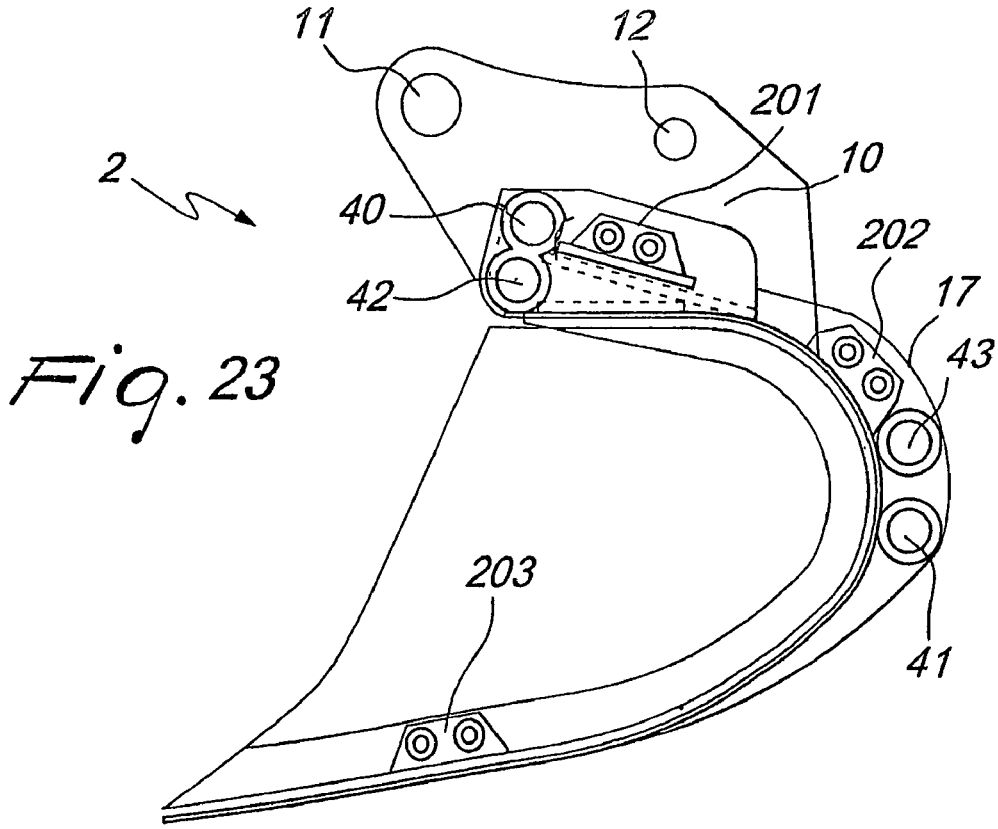
FIG. 23 is a sectional view of the backhoe bucket of FIG. 22.
Figure 24:
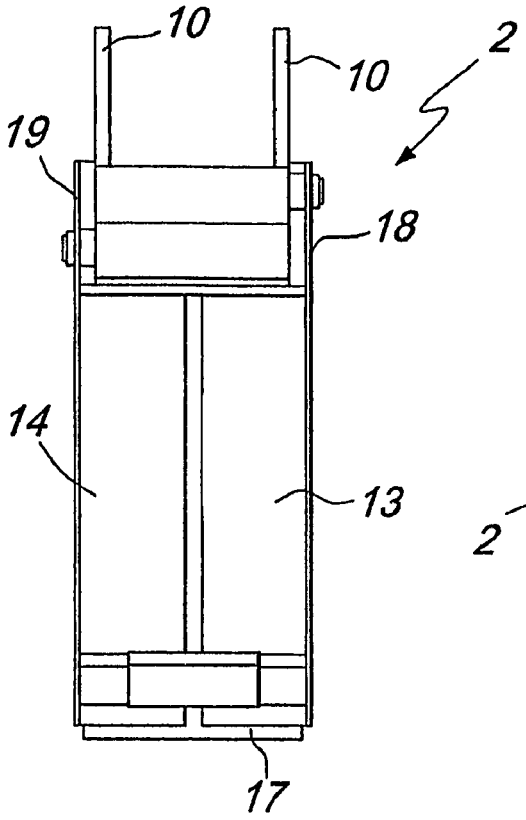
FIG. 24 is a front view of the backhoe bucket of FIG. 23, shown in the open position.
Figure 25:
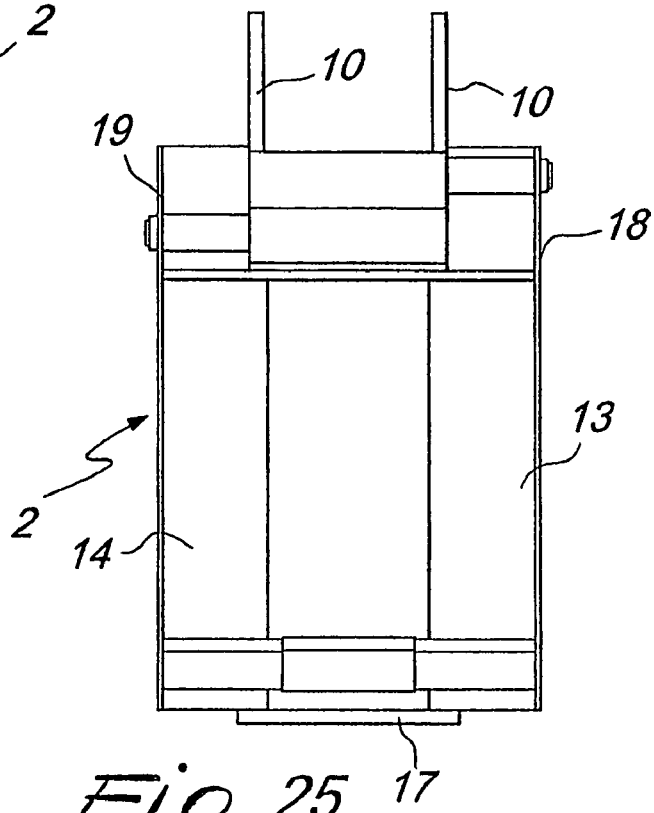
FIG. 25 is a view, similar to FIG. 24, but showing the backhoe bucket in the closed position.
Figure 26:
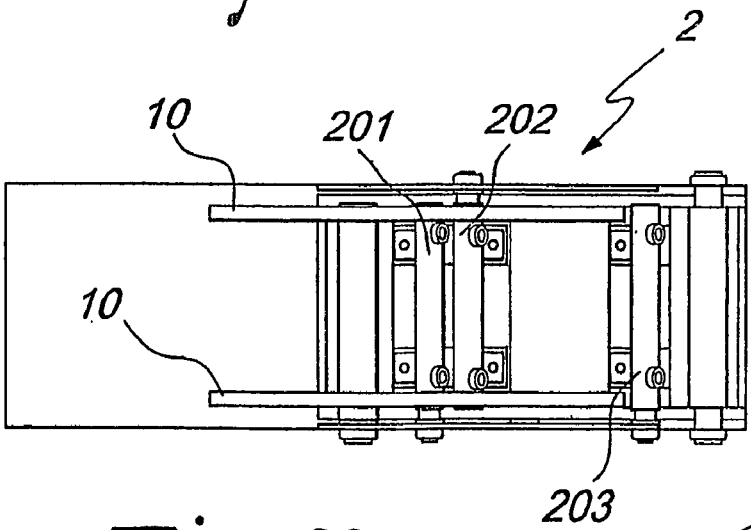
FIG. 26 is a plan view of the backhoe bucket of FIG. 25.
Figure 27:
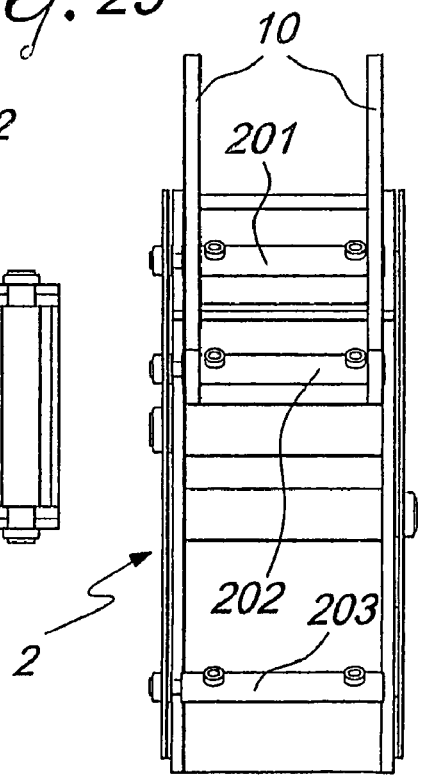
FIG. 27 is a rear view of the backhoe bucket of FIG. 26.
Figure 28:
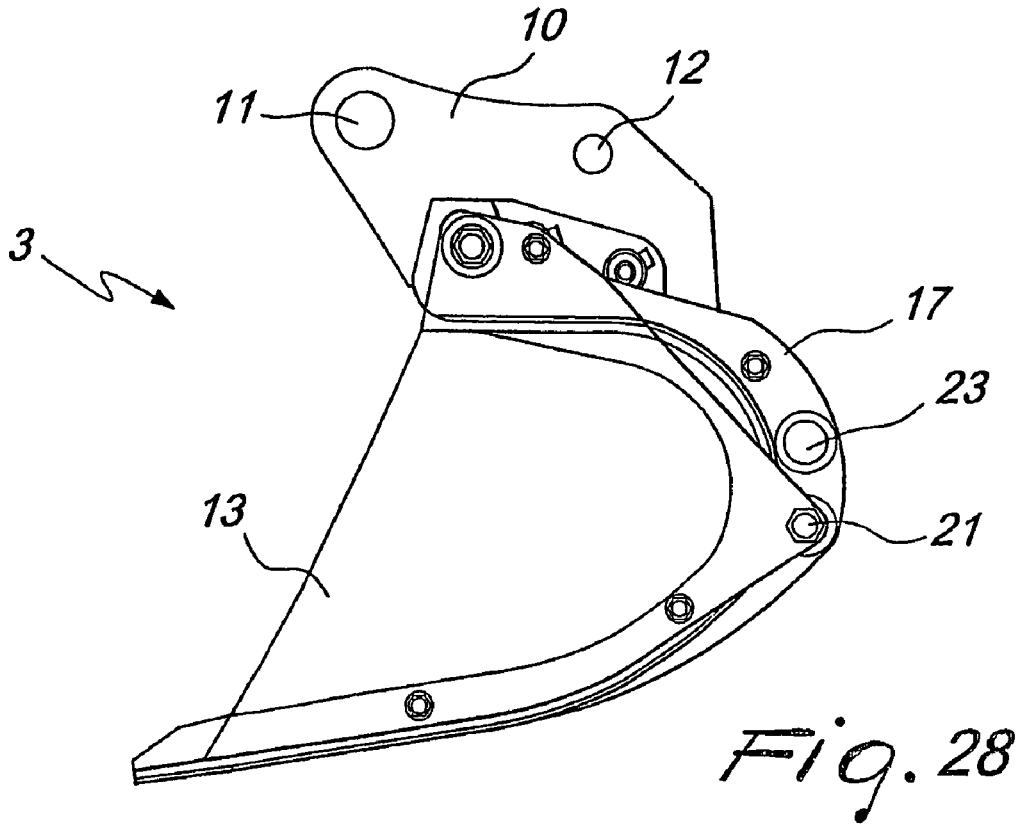
FIG. 28 is a side view of a large backhoe bucket provided with four pairs of cylinders.
Figure 29:
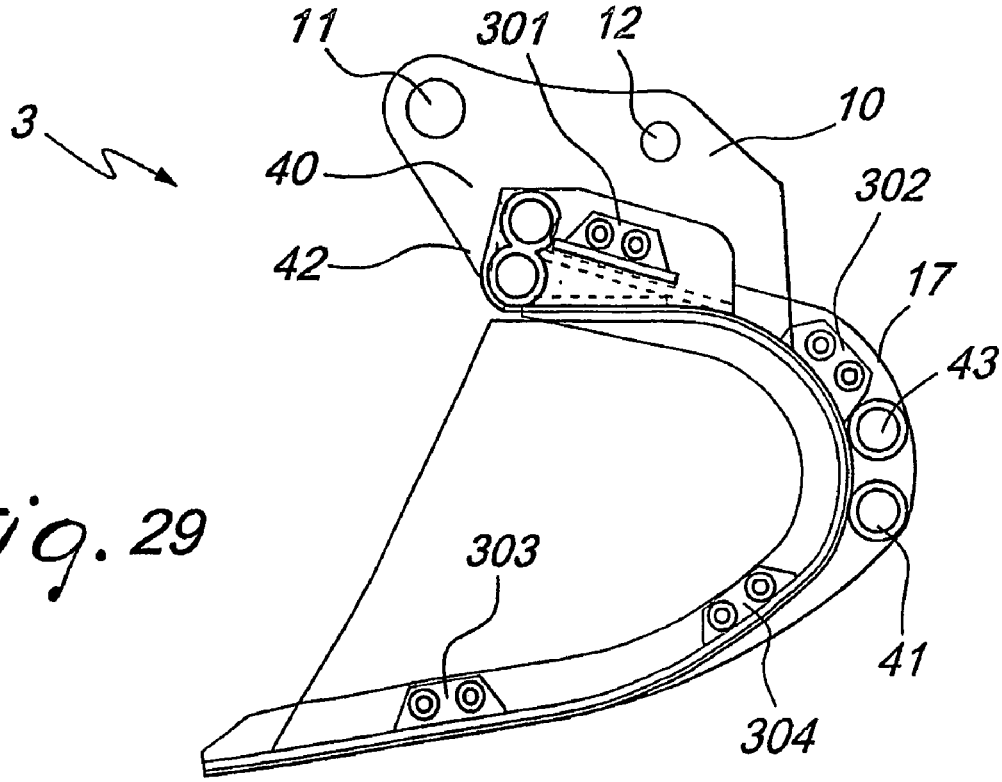
FIG. 29 is a sectional view of the backhoe bucket of FIG. 28.
Figure 31:
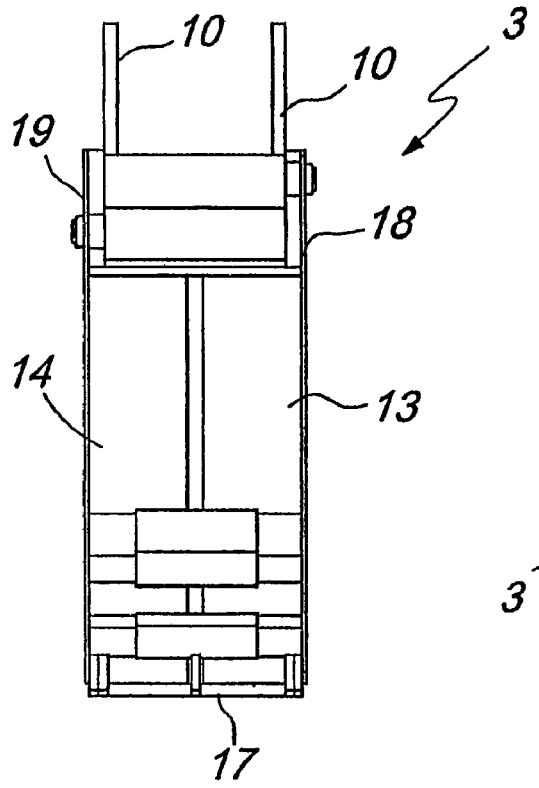
FIG. 31 is a view, similar to FIG. 30, but showing the backhoe bucket in the closed position.
Figure 30:
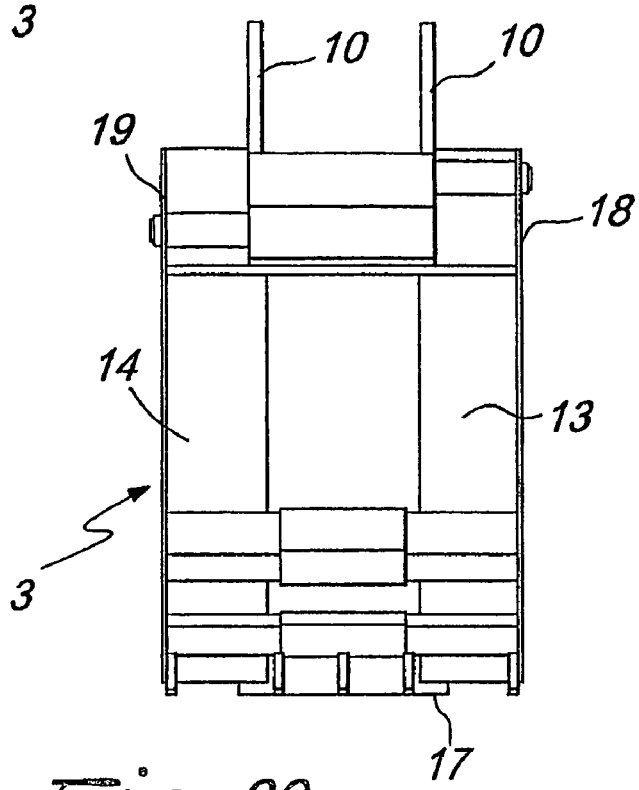
FIG. 30 is a front view of the backhoe bucket of FIG. 29, shown in the open position.
Figure 32:
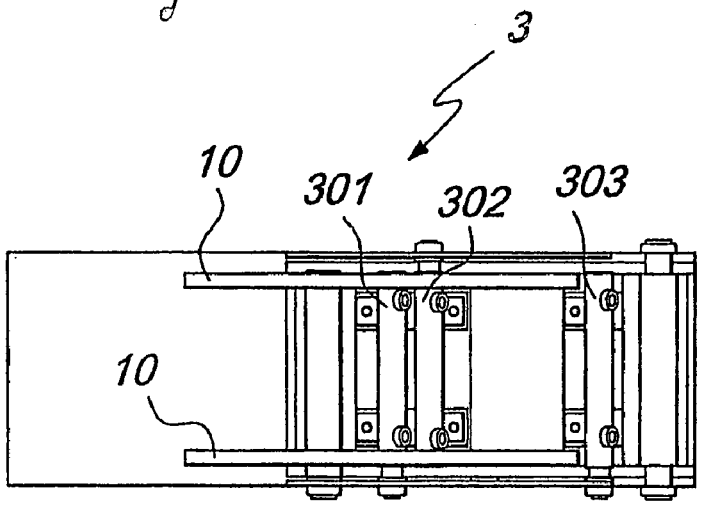
FIG. 32 is a plan view of the backhoe bucket of FIG. 31.
Figure 33:
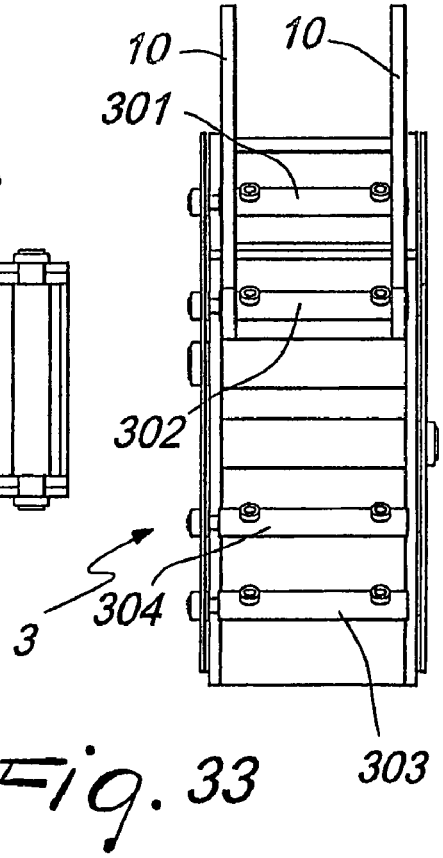
FIG. 33 is a rear view of the backhoe bucket of FIG. 31.
Figure 34:
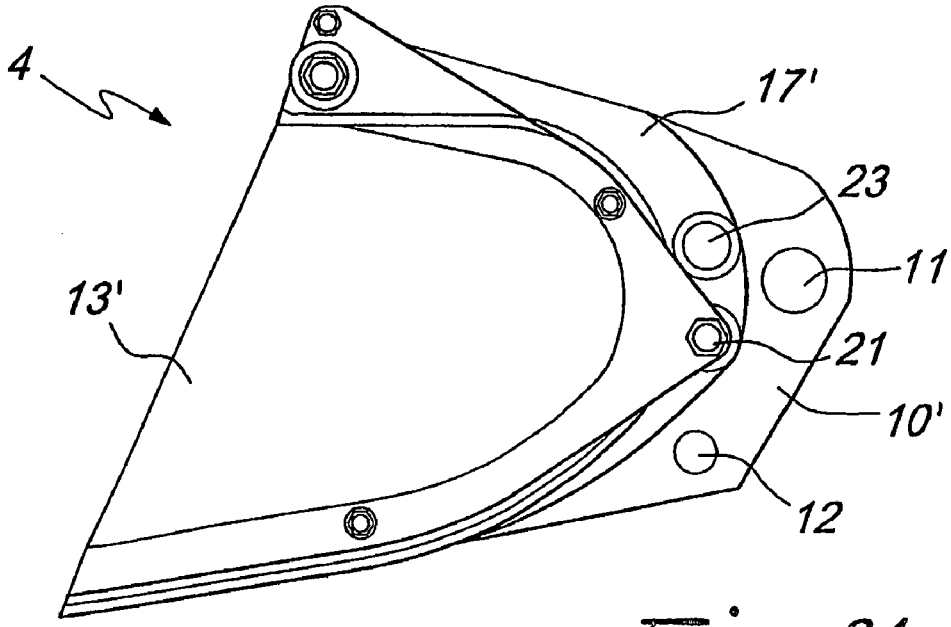
FIG. 34 is a side view of a loader bucket provided with three pairs of cylinders.
Figure 35:
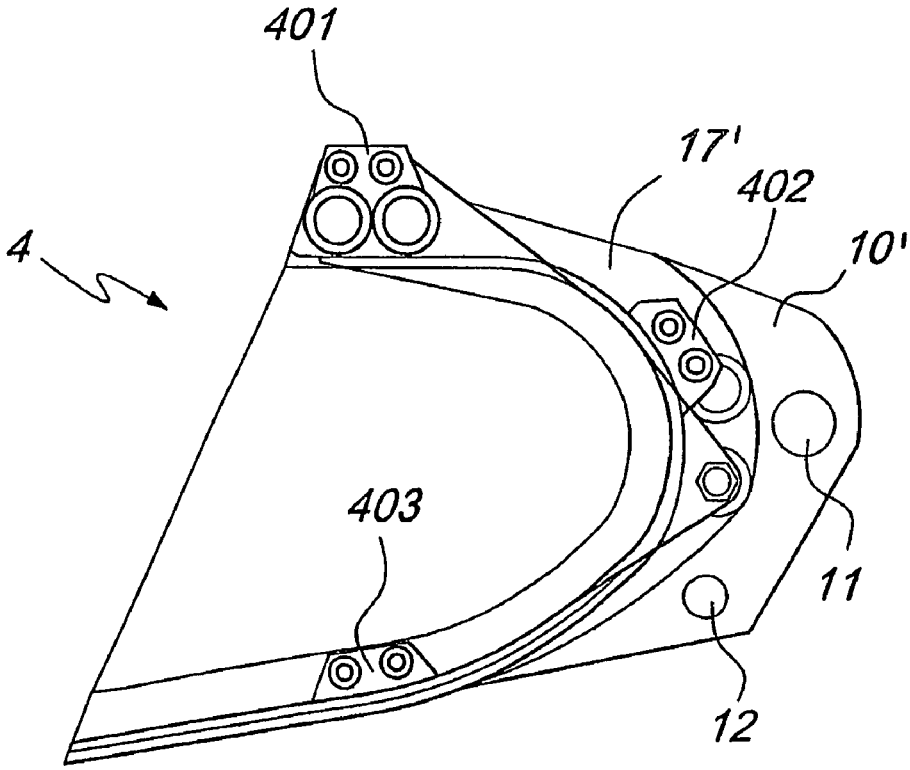
FIG. 35 is a sectional view of the loader bucket of FIG. 34.
Figure 39:
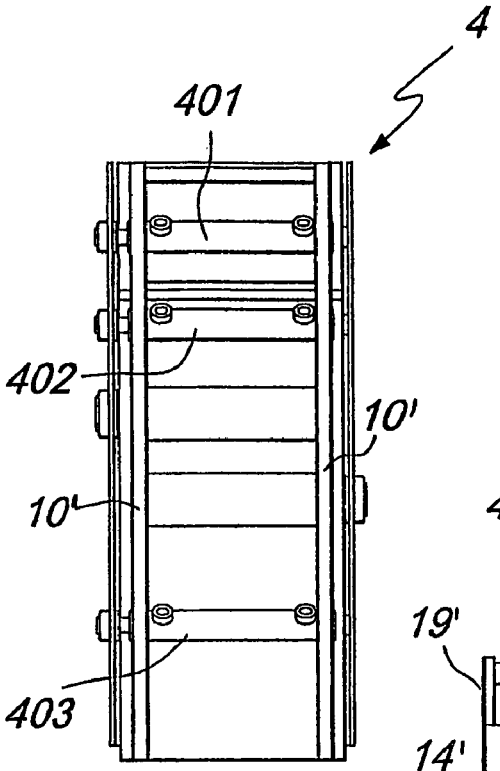
FIG. 39 is a rear view of the loader bucket of FIG. 38.
Figure 37:
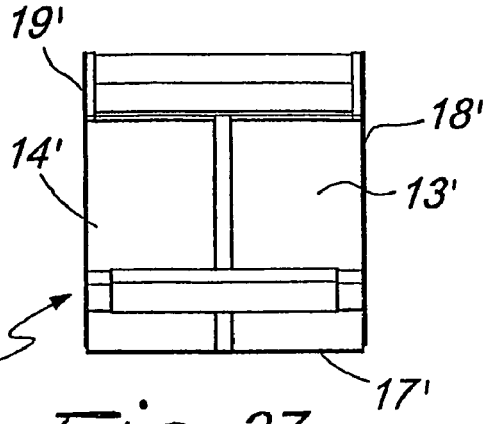
FIG. 37 is a view, similar to FIG. 36, but showing the loader bucket in the closed position.
Figure 36:
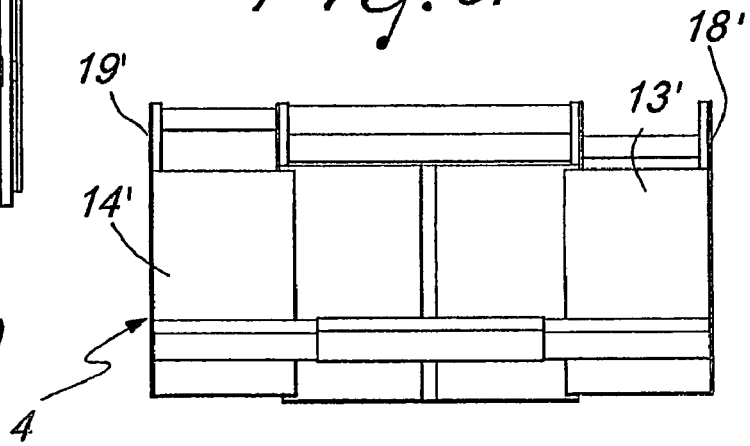
FIG. 36 is a front view of the loader bucket of FIG. 35, shown in the open position.
Figure 38:
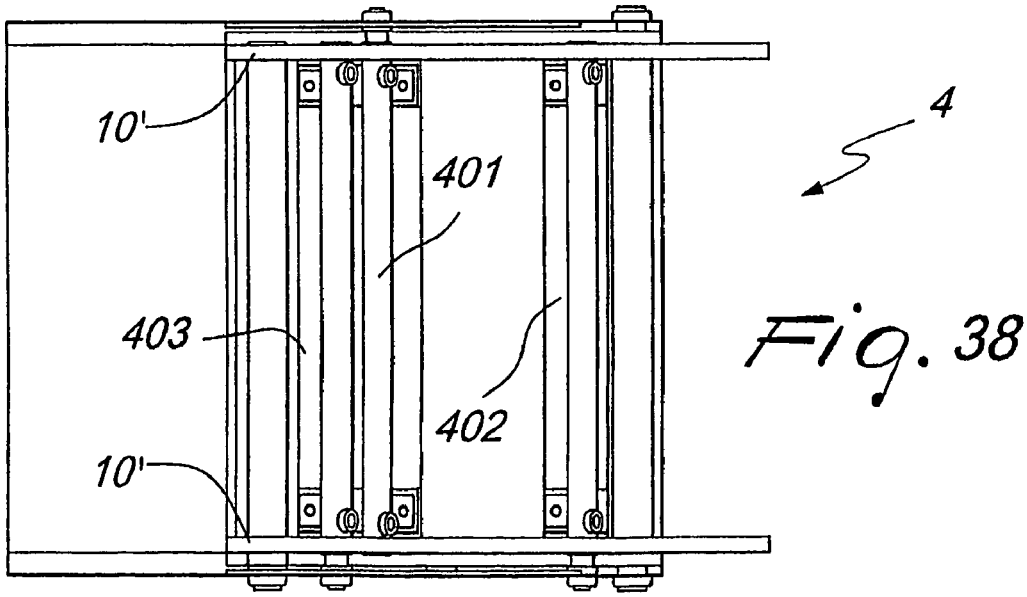
FIG. 38 is a plan view of the loader bucket of FIG. 37.

FIG. 13 is a front view of the loader bucket of FIG. 12 in the closed position and FIG. 14 is a front view of the loader bucket of FIG. 12 in the open position; FIG. 15 is a perspective view showing only the rigid structure 17' of a loader bucket, with a single movable member 13'. The reference numeral 24 designates the arm of the loader to which the frame 10' is connected.

The pistons are connected to the excavator by means of supply or hydraulic lines.

FIGS. 16-21 illustrate a small backhoe bucket, generally designated by the reference numeral 1, which is characterized by the presence of two pairs of actuation cylinders or pistons, designated by the reference numerals 101 and 102 respectively.

FIGS. 22-27 illustrate a medium backhoe bucket, generally designated by the reference numeral 2, which is characterized by the presence of three pairs of actuation cylinders or pistons, respectively designated by the reference numerals 201, 202 and 203.

FIGS. 28-33 illustrate a large backhoe bucket, generally designated by the reference numeral 3, characterized by the presence of four pairs of actuation cylinders or pistons, designated by the reference numerals 301, 302, 303 and 304 respectively.

FIGS. 34-39 illustrate a loader bucket, generally designated by the reference numeral 4, which is characterized by the presence of three pairs of actuation cylinders or pistons, designated by the reference numerals 401, 402 and 403 respectively.

The field of the present invention also includes an embodiment with a different number of sliding guides and/or pistons, a different arrangement or size thereof, and regardless of the way in which they are actuated, for example hydraulic or oleo pistons, pneumatic pistons, electric pistons, et cetera.

These characteristics in fact depend on the requirements of the market, of manufacture and of use, and on the size of the backhoe bucket or loader bucket. Furthermore, variations that have a different number of movable members and can be widened for example telescopically or in concertina fashion are understood to be also included.

Finally, the pistons can be replaced with other movement tools, such as chains, worm screws, belts or the like, anchored to the fixed structure and to the movable members.

The present invention includes all the detail variations and modifications that might be obvious to the person skilled in the art and are not beyond the scope of the present invention but are understood to be included within the scope of the claims that follow.

What is claimed is:

1. A bucket for backhoe or loader, comprising a fixed structure, which forms a rigid external member, and one or more movable members, which are complementary to the fixed structure and slide inside the fixed structure by means of adapted devices, wherein the adapted devices include pistons that are fixed to both the fixed structure and the movable members so as to actuate their mutual movement, sliding guides being arranged parallel to the direction of advancement of the pistons, said movable members being provided with respective protruding wings that support said sliding guides, said sliding guides connecting said movable members to said fixed structure, said protruding wings have different contours or shapes that allow coupling of a stem of a corresponding one of the pistons but leave free a space for movement of an opposite stem and allow coupling of corresponding ones of the sliding guides, thereby providing a compact bucket of greater capacity.

2. The bucket for backhoe or loader according to claim 1, wherein the fixed structure is substantially C-shaped and is obtained by means of a box-like and/or solid bent metal plate.

3. The bucket for backhoe or loader according to claim 1, wherein the movable members are made of a metal plate folded into a C-shape and have an external contour which is complementary to the internal contour of the fixed structure.

4. The bucket for backhoe or loader according to claim 1, wherein the movable members are two in number and are mirror-symmetrically identical except for a said protruding wings.

5. The bucket for backhoe or loader according to claim 4, wherein the pistons are each anchored by means of a cylinder to the fixed structure, while a stem is fixed to the protruding wings at holes, said pistons being arranged parallel to each other and working so as to generate a movement in two mutually opposite directions.

6. The bucket for backhoe or loader according to claim 1, wherein there are two sliding guides for each movable member.

7. The bucket for backhoe or loader according to claim 4, wherein holes are formed on the wings of the movable members for the passage of the guides and wherein corresponding similar holes are formed on the fixed structure.

8. The bucket for backhoe or loader according to claim 1, wherein the pistons are connected to an excavator by means of supply or hydraulic lines.

9. The bucket for backhoe or loader according to claim 1, comprising two pairs of actuation cylinders or pistons.

10. The bucket for backhoe or loader according to claim 1, comprising three pairs of actuation cylinders or pistons.

11. The bucket for backhoe or loader according to claim 1, comprising four pairs of actuation cylinders or pistons.

* * * * *